United States Patent [19]

Wittke

[11] 4,041,748

[45] Aug. 16, 1977

[54] METHOD AND APPARATUS FOR FABRICATING METAL CONTAINER

[76] Inventor: Eugene O. Wittke, 1609 - 29th St. SE., Medicine Hat, Alberta, Canada, T1A 2H8

[21] Appl. No.: 709,408

[22] Filed: July 28, 1976

[30] Foreign Application Priority Data

May 3, 1976 Canada ..... 251671

[51] Int. Cl.[2] ..... B21D 5/08

[52] U.S. Cl. ..... 72/166; 72/171; 72/213; 113/120 E

[58] Field of Search ..... 72/166, 169, 170, 149, 72/216, 212, 213, 94, 102, 171; 113/120 E

[56] References Cited

U.S. PATENT DOCUMENTS

| | | | |
|---|---|---|---|
| 965,018 | 7/1910 | Saunders | 72/213 |
| 3,738,149 | 6/1973 | Archer | 72/171 |

*Primary Examiner*—Milton S. Mehr

*Attorney, Agent, or Firm*—Fleit & Jacobson

[57] ABSTRACT

Apparatus and method for fabricating a rectangular waste disposal container from a single steel sheet, includes a cantilever shaped frame supporting a rectangular mandrel rotatable on a horizontal shaft. A vertically oriented hydraulic ram depends from an arm of the frame and has a tandem roller assembly pivotally mounted at its lower end with an axis parallel to the axis of the mandrel. A steel sheet is fed into the nip between the rollers and the mandrel and the latter is rotated while hydraulic pressure is applied to the rollers to press-break the sheet at the mandrel corners.

6 Claims, 16 Drawing Figures

METHOD AND APPARATUS FOR FABRICATING METAL CONTAINER

This invention relates to apparatus for and the method of manufacturing steel containers and specifically to rectangular containers for commercial waste disposal systems.

In the manufacture of metal containers such as those used for commercial waste disposal systems the conventional method of fabricating uses press-breaks that results in multiple handling of large partially formed sheets sheets of steel. Conventionally, this method is cumbersome in requiring the handling of heavy, awkward pieces of material and is quite expensive. In order to control the dimensions of containers made in the conventional manner, substantial effort is required on the part of serveral workers often working with two large formed sections that are brought together to form the four walls of the box. As a result, the size and shape of the open ended rectangle thus produced often does not exactly match the length, width and squareness of the pre-cut container ends and considerable reworking of the ends is often required.

Broadly, the present invention provides a device and method of forming a single large piece of steel into an open ended rectangle with good dimensional stability. A large rectangular mandrel is utilized and a single sheet of steel is wrapped around the mandrel to form the four sides of the container. The apparatus provides in effect a jig during the forming operating thereby improving the production of a uniformly sized and shaped piece. The device incorporates a rectangular mandrel rotating on a horizontal shaft. A horizontal cantilever arm incorporates a vertical hydraulic ram having a pair of rollers at its lower end, the rollers being forced by hydraulic pressure against the sheet and in turn against the rotating mandrel. The hydraulic pressure on the rollers allows them to move up and down over the rectangular mandrel as it rotates. The tandem roller assembly is pivotally mounted from the end of the hydraulic ram at a point equidistant above the centres of the two rollers.

Low pressure only is required on the hydraulic cylinder as the rollers operate on the flat portion of the mandrel but when a corner is reached, the pressure is increased to press-break the corner.

Steel sheet is fed into the nip between the tandem rollers and the mandrel surface and the steel sheet may include a stiffening rib which has been pre-welded to it. Such ribs are required on open ended containers that are equipped with hinged lids. Suitable gaps are provided in the rollers to allow the reinforcing rib to roll through without being flattened.

According to one broad aspect, the present invention relates to an apparatus for fabricating rectangular containers from a single steel sheet comprising a frame; a rectangular mandrel projecting from said frame and mounted for rotation about a horizontal axis; motor means for rotating said mandrel; a cantilever arm projecting outwardly of the frame and substantially parallel with and above said mandrel horizontal axis; an end gate on the end of said arm and depending therefrom, pivot means on the end of said gate remote from said arm for rotatably supporting one end of the mandrel; kand vertically oriented hydraulic ram means mounted in said cantilever arm and having a tandem pressure roller assembly pivotally connected to the lower end of the piston rod thereof, said rollers being parallel with and directly above said mandrel rotational axis; said ram applying pressure through said tandem rollers against a steel sheet grasped between said rollers and the mandrel and rotated thereby to form said rectangular container.

According to another broad aspect, the present invention relates to a method of fabricating a rectangular waste disposal container from a single steel sheet comprising feeding said sheet between tandem rollers and the surface of a rectangular mandrel wherein the central longitudinal axis of the mandrel and the rollers are parallel with one another; and rotating said mandrel while hydraulically forcing the rollers against said sheet and mandrel; increasing said pressure at the corners of the mandrel and decreasing said pressure at the flat portions thereof.

The invention is illustrated in the accompanying drawings wherein.

APPARATUS FIGS. 1-10

Figure 1:
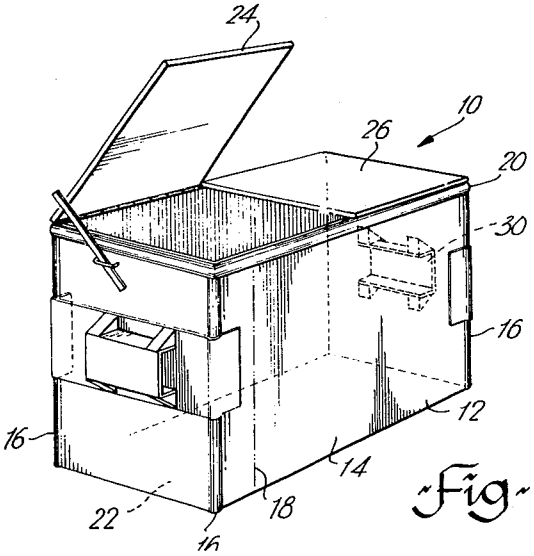
FIG. 1 is a perspective view of a waste container formed by the present invention.

In accordance with the method of manufacture disclosed herein, a single steel sheet with or without a reinforcing rib is formed into a four sided container requiring only one seam weld. Such a container in completed form is shown at 10, in FIG. 1 having walls 12 formed from a steel sheet 14 with formed corners 16 and a welded seam 18. Sheet 14 includes a reinforcing rib 20 around the top of container 10 and a bottom wall 22 is welded to complete the box configuration. Hinged lids 24, 26 may be provided together with rectangular pockets 28, 30 secured to the side walls of the container for reception of arms of a fork lift container dump truck.

Figure 2:
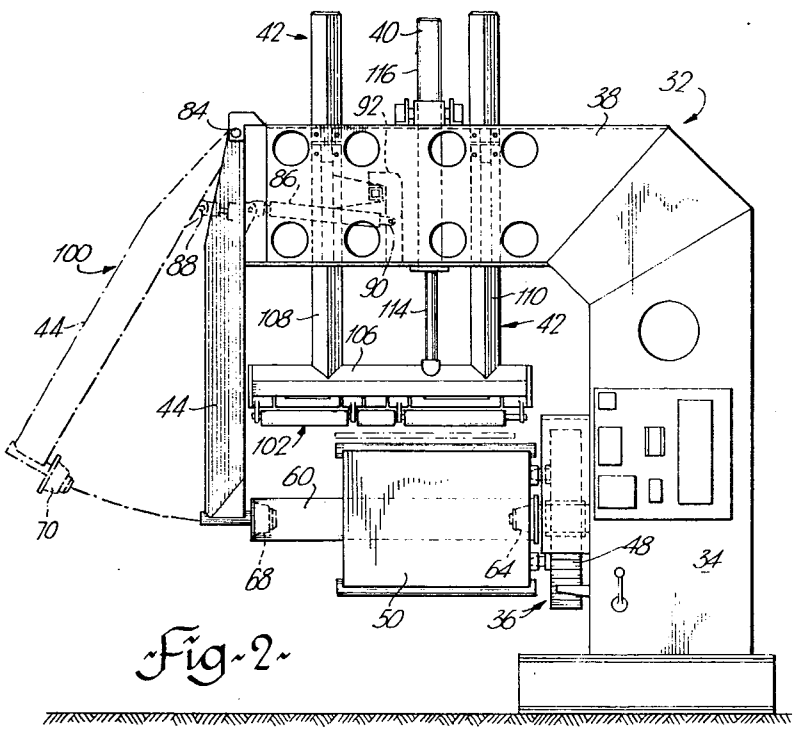
FIG. 2 is a side elevation of the container forming apparatus.

The apparatus for forming the container walls 12 is shown in FIG. 2. It comprises a large frame 32 having a vertical section 34 housing the mandrel rotating means 36 and, at its upper end, a cantilever arm section 38 extending horizontally outwardly and housing the hydraulic ram 40 and supporting the roller assembly 42 and an end gate 44.

The vertical section 34 of the frame 32 encloses a suitable motor, not shown, which provides suitable torque to rotate the mandrel under forming load. This motor actuates the rotating means 36 comprising a gear 46 (FIG. 3) engaging a larger gear 48 to which the mandrel 50 is mounted. It will be appreciated that mandrels of various configurations corresponding to the desired container size must be removably attached to the rotating means 36. Thus, mandrel 50 is mounted to the face 52 of gear 48 by means of locating studs 54 on the gear 48 and corresponding slideways 56 on the adjacent face 58 of the mandrel. Additionally, mandrel 50 has a central shaft 60 with a first frust-conical bearing 62 at one end for reception of a tapered end 64 of the shaft 66 on which the gear 48 is mounted. The other end of mandrel shaft 60 has a second frusto-conical bearing 68 for receiving a tapered pivot bearing 70 on the lower end of end gate 44.

Figure 3:
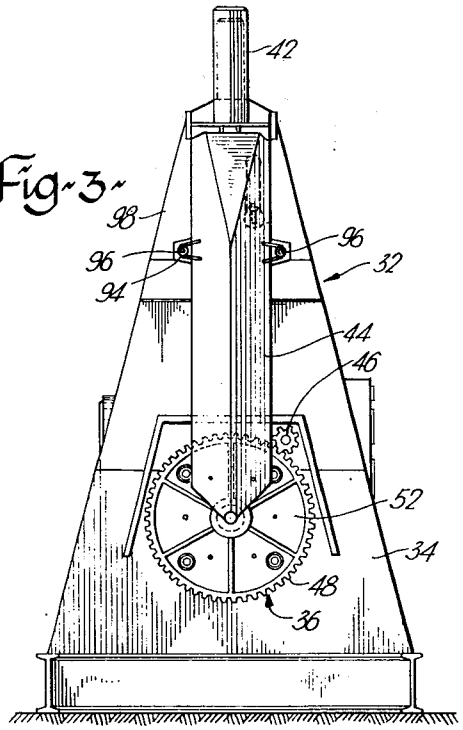
FIG. 3 is an end view of the apparatus shown in FIG. 2 with the mandrel removed.
Figure 6:
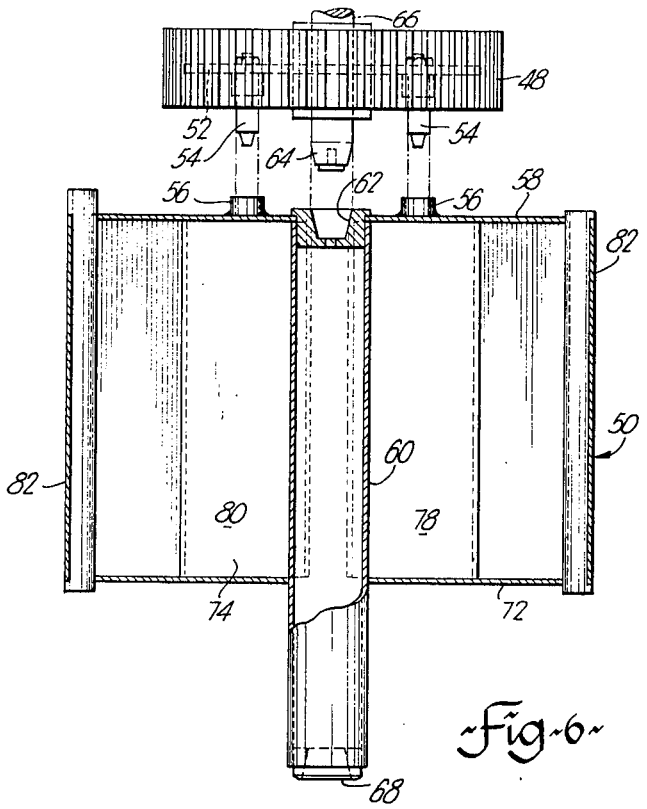
FIG. 6 is a side elevation, partly in section, of the mandrel and its mounting means.
Figure 7:
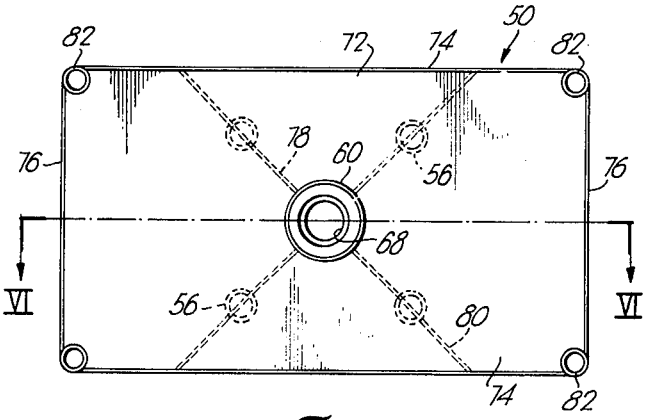
FIG. 7 is an end elevation of the mandrel of FIG. 6.

As seen in FIGS. 2, 6 and 7 the mandrel 50 comprises a box form including end faces 58 and 72, side walls 74, 76, reinforcing webs 78 and 80 and tubular corner members 82 as well as the aforementioned central shaft and bearings 60, 62 and 68 respectively. The mating of the corner members 82 and its associated side walls 74 and 76 is not tangential. The tubular corners 82 stand out approximately three-sixteenths inches over the side walls. Referring again to FIG. 2, end gate 44 is pivotally connected at 84 to the end of the cantilever arm 38 for swinging movement between operative and non-operative positions shown in full and phantom line respectively. Movement to and from these positions is effected by an hydraulic ram 86 secured at one end 88 to the gate 44 and at its other end 90 to suitable bracing 92 within the cantilever arm 38 as shown. Gate 44 is provided with a pair of lugs 94 for engagement with locating pins 96 mounted on end face 98 of the arm 38 as illustrated in FIG. 3.

It will be understood from the foregoing that movement of the end gate 44 to the open position 100 of FIG. 2 allows attachment or removal of a mandrel 50 from the associated rotating means 36 and removal of a formed container wall structure from the mandrel 50.

Figure 5:
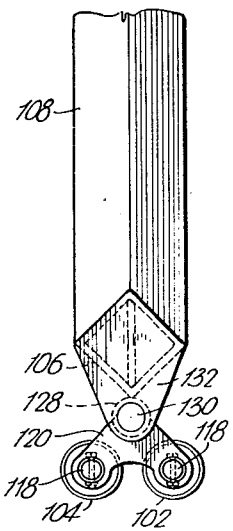
FIG. 5 is an end elevation of the roller assembly shown in FIG. 4.
Figure 4:
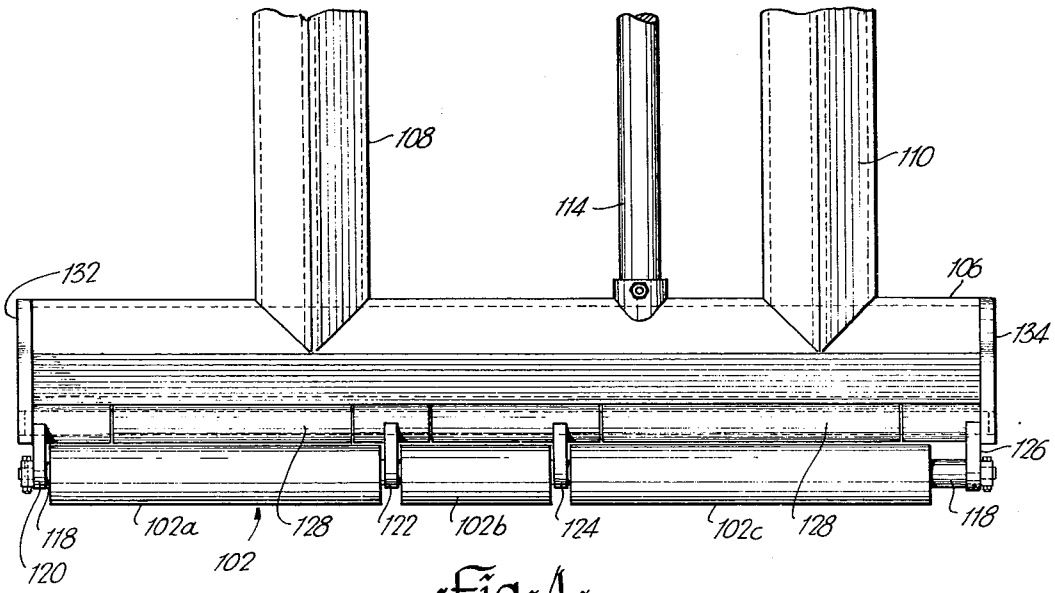
FIG. 4 is a side elevation of the tandem roller assembly.

The roller assembly 42 is shown in FIGS. 2, 4 and 5. The assembly comprises tandem rollers 102, 104 pivotally secured to a support structure consisting of a horizontal box-shaped member 106 and a pair of parallel vertical members 108, 110 secured thereto and which extend upwardly into and through the cantilever arm 38 which provides guideways 112 for the vertical movement of the members 108, 110 as shown in FIG. 2. Hydraulic ram 40 has its piston end 114 secured to the horizontal roller member 106 and its cylinder 116 is secured to the cantilever arm 38. Thus, actuation of ram 40 results in upward or downward movement of the roller assembly 42 relative to the mandrel 50.

Rollers 102 and 104, as seen in FIG. 4, each include three sub-sections such as 102*a*, 102*b* and 102*c* all of which are rotatably mounted on shafts 118 that, in turn, are secured at their ends and intermediate their length by hanger and spacing plates 120, 122, 124 and 126. Plates 120–126 are secured to roll cylinders 128 mounted rotatably on a single horizontal shaft 130. The horizontal assembly support member 106 has depending end plates 132 and 134 and these support the shaft 130 as shown in FIGS. 4 and 5. It will be appreciated from the foregoing that the tandem rollers 102, 104 are free to rotate or swing about the central shaft 130.

Figure 8:
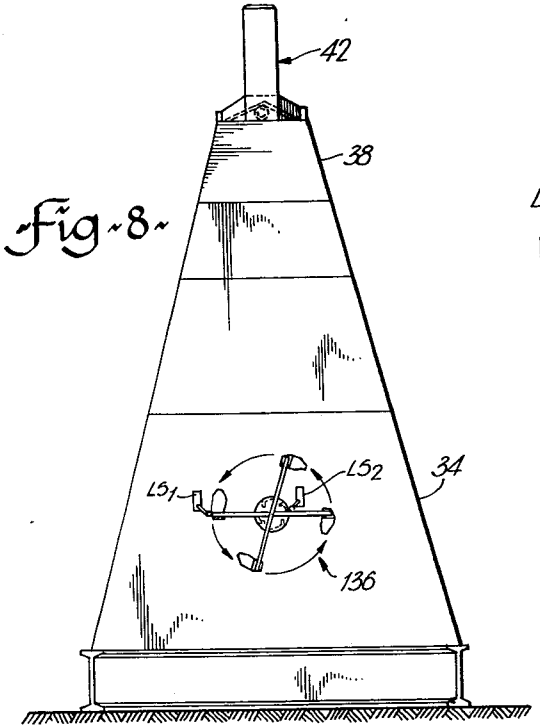
FIG. 8 is a rear elevation view of the forming device of FIG. 2.
Figure 9:
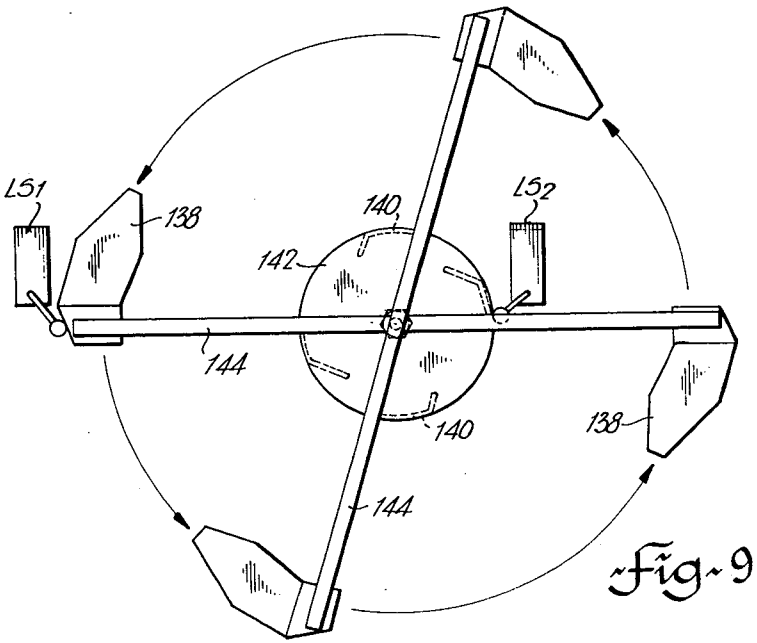
FIG. 9 illustrates the means for actuating the hydraulic pressure on the rollers.
Figure 10:
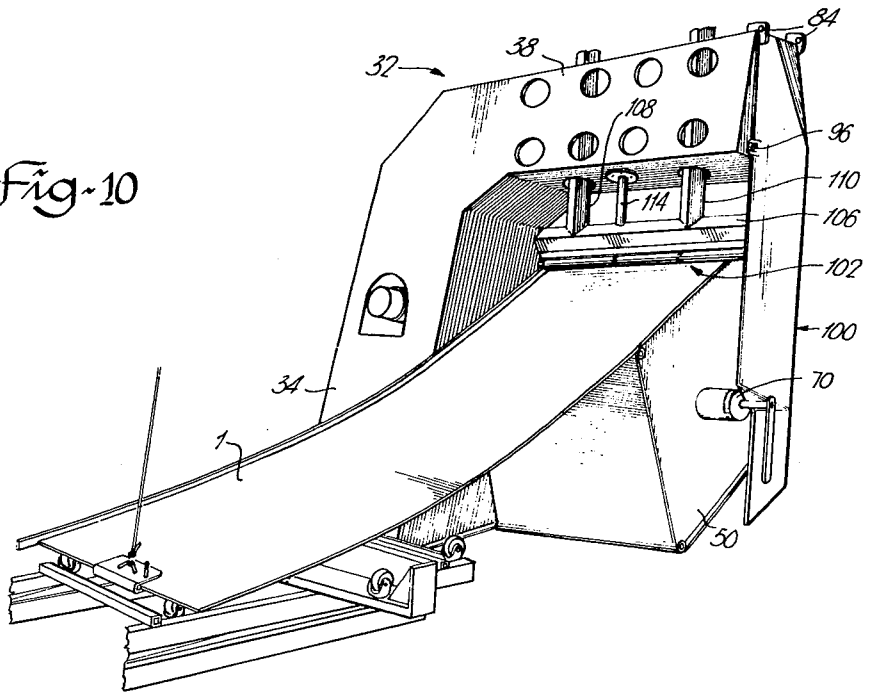
FIG. 10 is a perspective view showing a steel sheet being formed by the rotating mandrel.

The hydraulic circuitry of FIGS. 12 through 16 is governed by adjustable limit controls generally indicated at 136 in FIGS. 8 and 9. These controls include limit switches LS1 and LS2 fixed on the back of the machine frame 34 and are actuated by long and short radius cams 138 and 140 respectively which are attached indirectly to the mandrel 50 through its shaft 66. Short radius cams 140 are mounted on a plate 142 and long radius cams are mounted on arms 144.

METHOD AND SEQUENCE OF OPERATION, FIGS. 11–16

Figure 11:
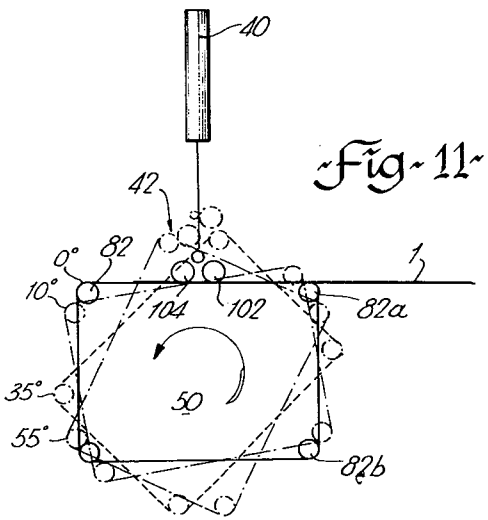
FIG. 11 is a schematic illustration indicating the various positions of the rollers and mandrel during forming, and FIGS. 12 through 16 inclusive are circuit drawings showing actuation of the hydraulic ram in response to the positioning of the mandrel and the control means of FIG. 9.
Figure 12:
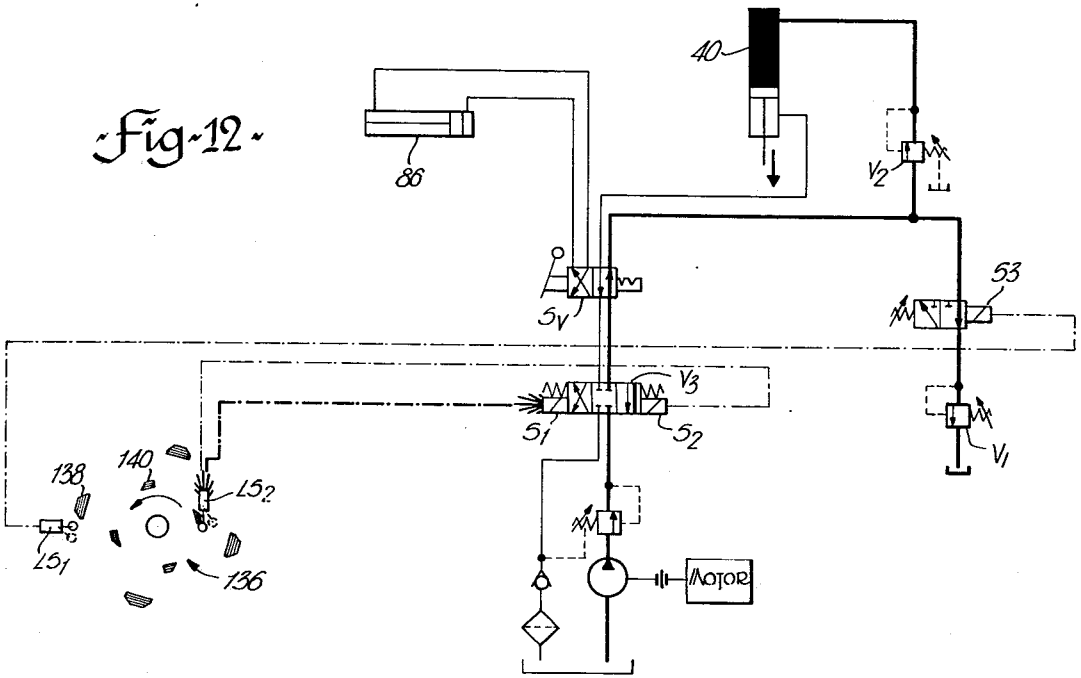
Figure 13:
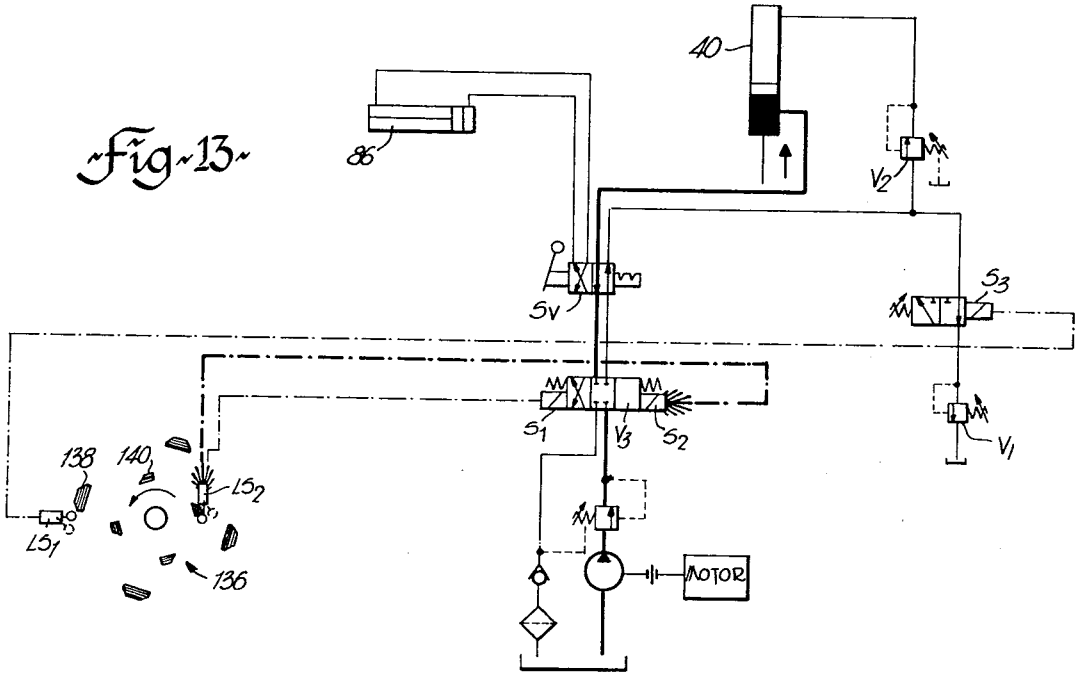
Figure 14:
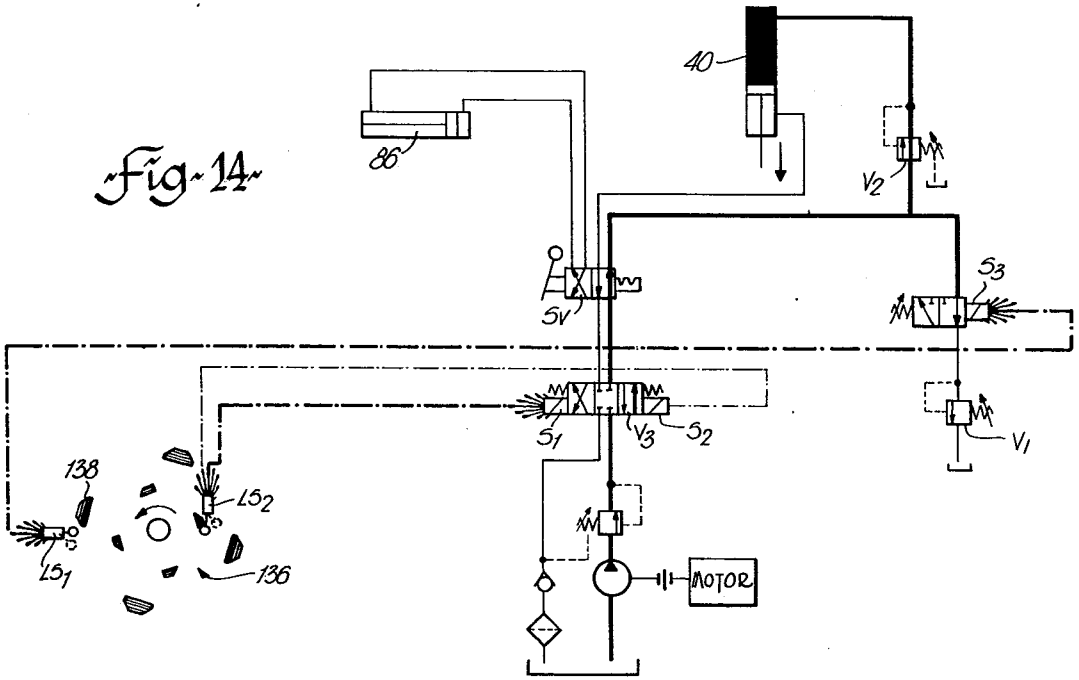

For a complete understanding of the operational sequence, description relating to FIGS. 12–16 will also refer to the various degrees of mandrel rotation shown in FIG. 11. In FIGS. 12–16, hydraulic lines are shown in full, electrical lines in dot and peck. In each case, the heavy line is in actuation. FIG. 12 is identical schematically for operations A and D and FIG. 13 is identical schematically for sequences B and E. As shown in FIG. 11, a steel sheet 1 is placed on and clumped to the surface of the mandrel 50 with its terminal end being short of the far corner 82 thereof.

SEQUENCE A, FIG. 12

With electrics and hydraulics on, the selector valve SV is placed in a "forming" position. Limit switch LS2 in a normal position activates solenoid S1 moving spool of valve V3 to the left. Hydraulic fluid flows to the top of ram 40 thereby forcing roller assembly 42 down onto the steel sheet 1 and mandrel 50. Solenoid S3 in its normal position relieves flow to the top of ram 40 to approximately 250 PS1. The mandrel 50 (and its cams 138, 140) are then rotated from an operating consol.

SEQUENCE B, FIG. 13

At approximately 10° before T.D.C. (FIG. 11) limit switch LS2 is activated by a short radius cam 140. Electric current is switched from solenoids S1 and S2, reversing hydraulic flow through valve V3. Hydraulic flow is directed to the bottom of the ram 40 causing the roller assembly 42 to rise with the rotating mandrel 50 at a controlled rate with the rollers 102, 104 continuing to apply pressure on the steel sheet 1.

SEQUENCE C, FIG. 14

At about 35° of mandrel rotation, FIG. 11, limit switch LS2 is deactivated, switching current from solenoid S2 to solenoid S1. Hydraulic flow is directed to the top of the ram 40 causing the roller assembly 42 to press down on the mandrel 50 at about 10° before the apex of corner 82*a*. Concurrrently, limit switch LS1 is activated energizing solenoid S3, blocking fluid flow to relief valve V1. Hydraulic pressure is maximized, controlled by the setting on a pressure reducing valve V2 to approximately 450 PS1. This pressure continues until 10° after the apex of corner 82a, pressing the steel sheet to form a 90° corner. The duration of the pressure of pressure is controlled by the effective length of the outer cams 138 as will be appreciated from FIG. 9.

SEQUENCE D, FIG. 12

At approximately 55° of mandrel rotation limit switch LS1 is deactivated. Current is withdrawn from solenoid 53 causing relocation of the valve spool and allowing hydraulic flow to relief valve V1. Accordingly the roller assembly moves downwardly at controlled pressure.

SEQUENCE E, FIG. 13

At approximately 90° of mandrel rotation limit switch LS2 is activated energizing solenoid S2, again reversing hydraulic flow to the bottom of ram 40 causing the roller assembly to rise at a controlled pressure.

One steel box 90° corner is now formed and sequences B through E are automatically repeated three more times. Sequence B, FIG. 13, occurring at 0°, 90°, 180° and 270° of mandrel rotation.

Figure 15:
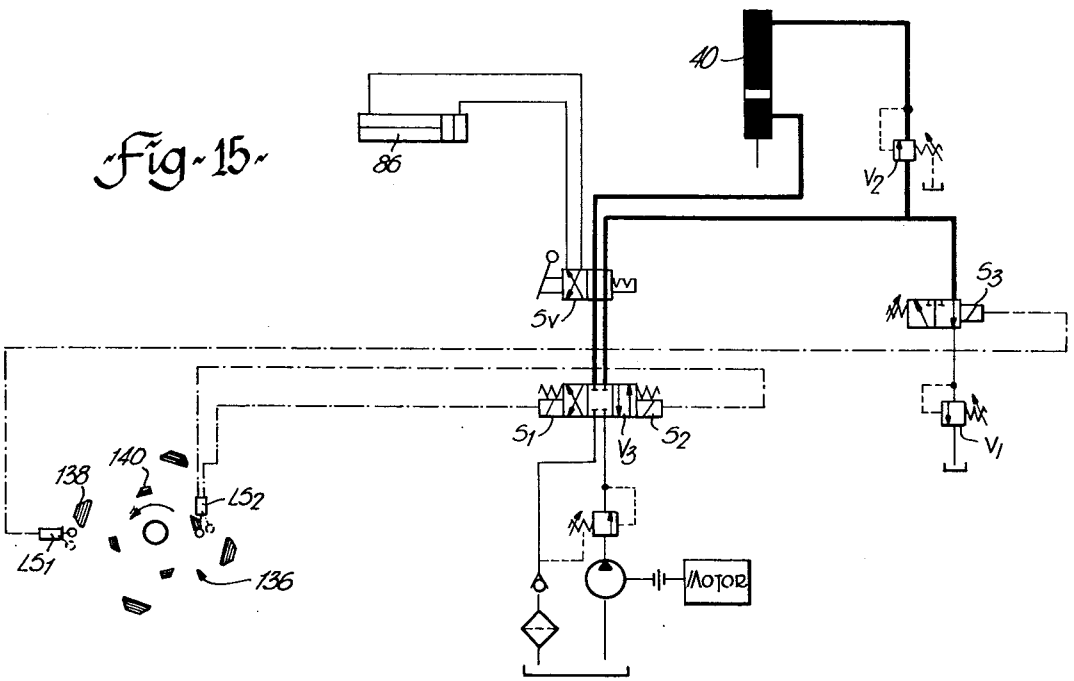
Figure 16:
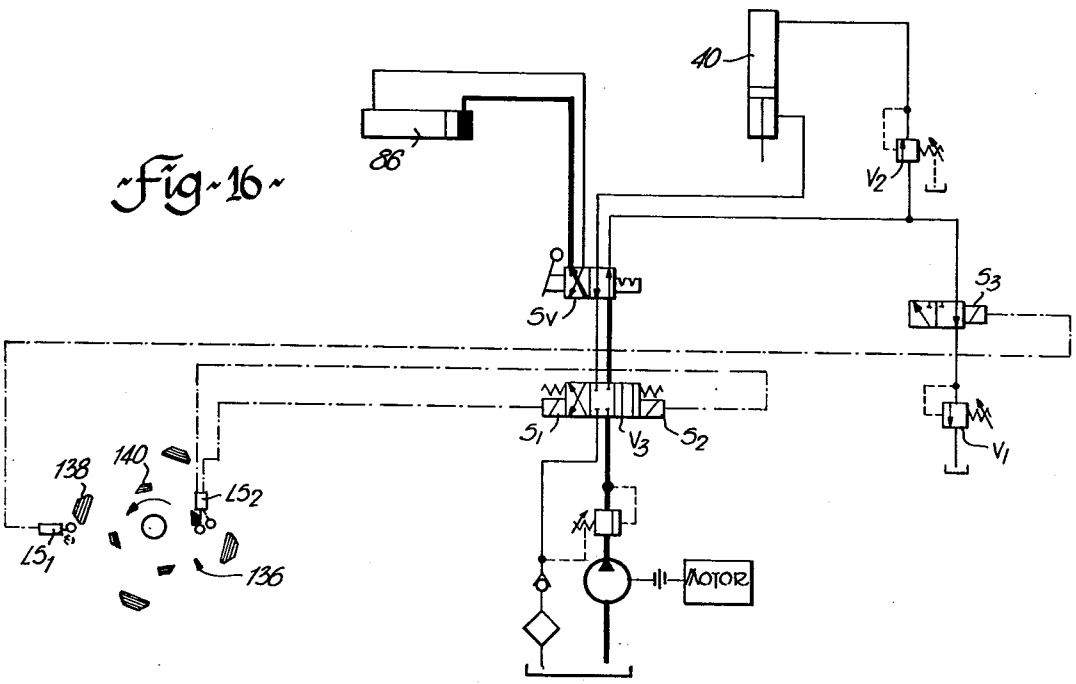

As shown in FIG. 15, at about 330° of mandrel rotation a permanent internal limit switch over-rides LS2 to neutralize solenoids S1 and S2 to centre the spool on valve V3 which stops hydraulic flow. This holds the ram 40 in an 'up' position to clear a metal clamp on the mandrel 50 and at 360° of mandrel rotation a second permanent internal limit switch shuts off the mandrel rotating means. The removal of the box from the mandrel is shown in FIG. 16. With the steel sheet 1 wrapped 360° around the mandrel 50 and rotation thereof bolted, the selector valve SV is placed in the "end gate" position and solenoid S1 of valve V3 is consol activated causing the gate cylinder 86 to extend swinging the gate 44 to its open position 100 of FIG. 2, thereby allowing the steel box to be removed from the mandrel 50. Solenoid S2 of valve V3 is subsequently activated to return the gate 44 to the mandrel 50.

While the present invention has been described in connection with a specific embodiment thereof and in a specific use, various modifications thereof will occur to those skilled in the art without departing from the spirit and scope of the invention as set forth in the appended claims.

The terms and expressions which have been employed in this specification are used as terms of description and not limitation, and there is no intention in the use of such terms and expressions to exclude any equivalents of the features shown and described or portions thereof, but it is recognized that various modifications are possible within the scope of the invention as claimed.

I claim:

1. Apparatus for fabricating rectangular containers from a single steel sheet comprising a frame; a rectangular mandrel projecting from said frame and mounted for rotation about a horizontal axis; motor means for rotating said mandrel; a cantilever arm projecting outwardly of the frame and substantially parallel with above said mandrel horizontal axis; an end of gate on the end of said arm and depending therefrom, pivot means on the end of said gate remote from said arm for rotatably supporting one end of the mandrel; and vertically oriented hydraulic ram means mounted in said cantilever arm and having a tandem pressure roller assembly pivotally connected to the lower end of the piston rod thereof, said rollers being parllel with and directly above said mandrel rotational axis; said ram applying pressure through said tandem rollers against a steel sheet grasped between said rollers and the mandrel and rotated thereby, to form said rectangular container.

2. A method of fabricating a rectangular waste disposal container from a single steel sheet comprising feeding said sheet between tandem rollers and the surface of a rectangular mandrel wherein the central longitudinal axis of the mandrel and the rollers are parallel with one another; and rotating said mandrel while hydraulically forcing the rollers against said sheet and mandrel; increasing said pressure at the corners of the mandrel and decreasing said pressure at the flat portions thereof.

3. Apparatus according to claim 1 wherein said mandrel rotating means comprises a motor driven horizontal shaft mounted in said frame and a gear mounted on said shaft, said mandrel being detachably connected at one of its ends to said gear.

4. Apparatus according to claim 2 wherein said mandrel comprises a box configuration having side walls, end faces and a central shaft; and frusto-conical bearing surfaces in each end of the mandrel shaft for receiving bearing heads of like configuration on said motor shaft and end gate.

5. Apparatus according to claim 1 wherein said tandem caller assembly comprises a horizontal support member and a pair of vertical, spaced members secured thereto and extending upwardly through guideways in said cantilever arm, the hydraulic arm being intermediate said vertical members and having its piston end secured to the horizontal support member and its cylinder end secured to the cantilever arm; a shaft centrally supported from the lower end of the support member and the tandem rollers being spaced on either side of and below said shaft and pivotally connected thereto.

6. Apparatus according to claim 1 including switch and cam means mounted on said mandrel rotating means for activating said ram and gate responsive to mandrel rotation.

* * * * *